United States Patent [19]

Farquhar

[11] 4,030,661

[45] June 21, 1977

[54] CARTON AND BLANK FOR MAKING SAME

[75] Inventor: Melville T. Farquhar, Richmond, Va.

[73] Assignee: Reynolds Metals Company, Richmond, Va.

[22] Filed: Apr. 12, 1976

[21] Appl. No.: 675,754

[52] U.S. Cl. ..... 229/52 B; 229/52 BC; 229/17 B; 206/141; 206/430

[51] Int. Cl.² ..... B65D 5/46

[58] Field of Search ..... 229/3.5 MF, 52 B; 206/141, 430

[56] References Cited

UNITED STATES PATENTS

| | | | |
|---|---|---|---|
| 2,900,124 | 8/1959 | Leone | 229/52 B |
| 2,916,195 | 12/1959 | Gatward | 229/52 B |
| 3,227,353 | 1/1966 | Bump | 229/52 B X |
| 3,416,719 | 12/1968 | Pilger | 229/52 B X |
| 3,417,911 | 12/1968 | Hennessey | 229/52 B X |
| 3,515,331 | 6/1970 | Guthrie, Sr. | 229/3.5 MF X |
| 3,750,933 | 8/1973 | Nicolay | 229/52 B X |
| 3,776,108 | 12/1973 | Nock | 229/52 B X |
| 3,933,303 | 1/1976 | Kirby, Jr. | 229/52 B |

*Primary Examiner*—Davis T. Moorhead
*Attorney, Agent, or Firm*—Glenn, Lyne, Gibbs & Clark

[57] ABSTRACT

A carton and blank for making same are provided with the carton having a rectangular top wall and a handle of improved strength due to the handle being provided as an integral part of the top wall and hingedly attached at diagonally opposite corners to thereby provide a comparatively rigid non-flexing attachment.

20 Claims, 8 Drawing Figures

CARTON AND BLANK FOR MAKING SAME

BACKGROUND OF THE INVENTION

Carbonated beverages such as beer, soft drinks, and the like are often sold in containers such as metal cans which are packaged, stored, and sold in cartons often comprised of paperboard having metallic foil laminated against a surface thereof such as the outside surface thereof.

Each of such cartons usually has a rectangular top wall and a handle often made of integral handle portions of the top wall and such handle portions usually have bases hingedly attached parallel to opposed rectangular edges of the top wall whereby loads are transferred to side panels of the carton across the top wall causing the top wall to tend to bow upwardly and such handle portions to tear out at the above-mentioned bases. The strength of each handle defined by handle portions of the character mentioned is even less when the carton on which such handle is provided is made of thinner stock or of recycled materials.

SUMMARY

This invention provides an improved carton and blank for making same with the carton having a handle of improved strength.

In particular, the carton is comprised of a bottom wall, a pair of end walls, and a pair of side walls adjoining opposite side edges of the bottom wall with each of the side walls having an edge remote from the bottom wall. A pair of extension flaps are provided with each adjoining and extending from an associated remote edge and the extension flaps are fastened together to define a rectangular top wall for the carton; and, cut and score means is provided in each of the extension flaps defining an associated handle portion with the handle portions being disposed against each other to define a handle for the carton. The score means in each extension flap includes a pair of spaced score lines disposed in spaced relation substantially along a diagonal on opposite corners of the rectangular top wall to thereby define an integral hinge for an associated handle portion, the diagonal score lines in the opposite corners provide a comparatively rigid attachment for the handle portions with the rigid attachment assuring the handle has optimum strength due to minimum upward bowing of the top wall. The diagonal arrangement of the hinge lines also enables such hinge lines to be of maximum length which further increases the strength thereof.

Other details and advantages of the invention will become apparent as the following description of the embodiment thereof in the accompanying drawings proceeds.

BRIEF DESCRIPTION OF THE DRAWINGS

The accompanying drawings show a present preferred embodiment of the invention, in which.

DESCRIPTION OF ILLUSTRATED EMBODIMENTS

Figure 1:
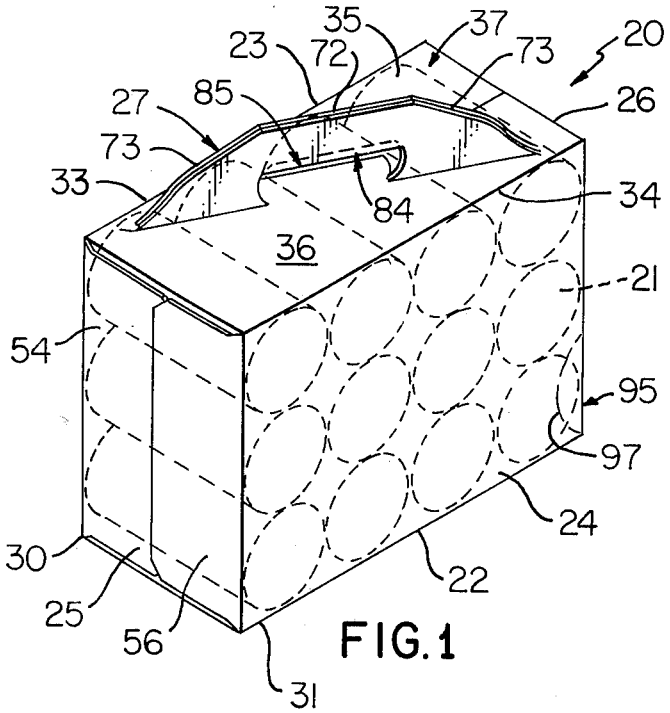
FIG. 1 is a perspective view of the carton of the invention having a plurality of metal cans contained therewithin.

Reference is now made to FIG. 1 of the drawings which illustrates an exemplary embodiment of the carton of this invention which is designated generally by the reference numeral 20 and such carton is particularly adapted to contain a plurality of containers which in this example of the invention are shown as a plurality of 12 cans 21 which may contain a carbonated beverage, such as beer, for example. The carton 20 may be made of paperboard, or the like, with metallic foil in the form of aluminum foil laminated against the surface thereof which defines the outside surface of the carton 20.

The carton 20 comprises a bottom wall 22, a pair of side walls 23 and 24, and a pair of end walls 25 and 26 and such carton has a high strength handle which is designated generally by the reference numeral 27 and such handle is shown in a substantially vertical or stand-up position and will be described in more detail subsequently.

The bottom wall 22 has opposed side edges 30 and 31 adjoined by the side walls 23 and 24 respectively and the side walls 23 and 24 have outer edges 33 and 34 respectively disposed remote from the bottom wall 22.

The carton 20 has a pair of extension flaps 35 and 36 each adjoining and extending from an associated remote edge; and, it will be seen that the flap 35 extends from edge 33 while the flap 36 extends from edge 34 and the extension flaps 35 and 36 are fastened together to define a rectangular top wall 37 for the carton 20.

The carton 20 has cut and score means in each extension flap 35 and 36 designated in each instance generally by the reference numeral 40 and the cut and score means define an associated handle portion 41 in each flap 35 and 36. As seen in FIG. 1 and as will be described in more detail subsequently, the handle portions 41 are disposed against each other to define the handle 27 for the carton 20 and the handle 27 is of maximum length due to its handle portions being hingedly attached along diagonally disposed or arranged areas or hinge lines of maximum length which help increase the strength of the handle 27.

Figure 4:
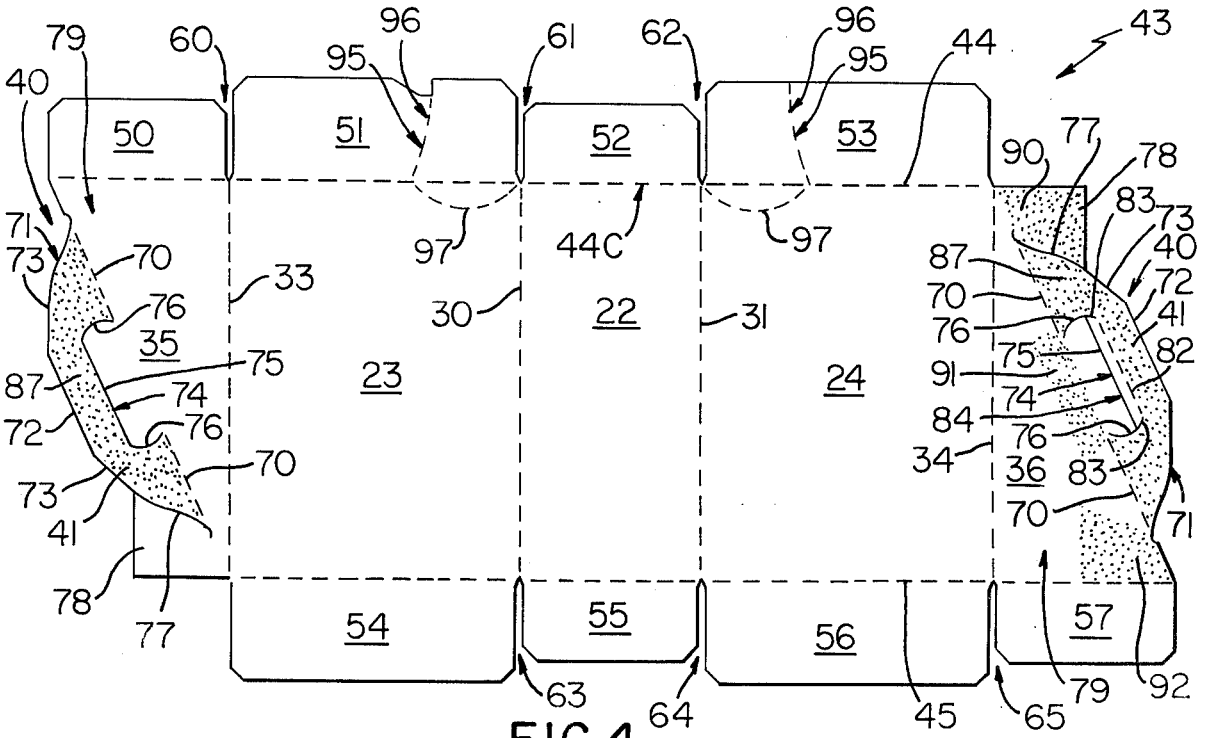
FIG. 4 is a plan view of the blank used to make the carton of FIG. 1.

The container 20 may be made in any suitable manner and from any suitable foldable material; however, such container is preferably made from the container blank which is designated generally by the reference numeral 43 and is illustrated in FIG. 4 of the drawings. The blank 43 may be made of paperboard, or the like, and may have one or both surfaces thereof laminated with metallic foil, such as aluminum-containing metallic foil, or the like, suitably colored, embossed, imprinted, or remaining plain, as desired.

The blank 43 will now be described together with the description of the carton; and, it will be noted that parts of the blank 43 will be designated by the same reference numerals as corresponding parts of the assembled carton 20 and this has been done for ease of description and clarity.

The blank 43 has a central portion defining bottom wall 22 and a pair of equal length parallel score lines 30 and 31 which define opposite side edges of the bottom wall 22. The blank 43 also has a pair of side walls 23 and 24 adjoining the side edges or score lines 30 and 31 respectively with the side walls 23 and 24 having edges remote from the bottom wall 22 defined by score lines 33 and 34 respectively; and, extension flaps 35 and 36 comprise the blank and such flaps adjoin and extend from associated remote edges or score lines 33 and 34 respectively.

The blank 43 has a pair of spaced parallel score lines 44 and 45 which extend across one full dimension thereof with the score line 44 adjoining one end of the score lines 33, 30, 31, and 34 and the score line 45 adjoining the opposed ends of the score lines 33, 30, 31, and 34. The blank 43 also has a plurality of four end flaps 50, 51, 52, and 53 extending outwardly of score line 44 which are adapted to be suitably folded and fastened substantially coplanar to define the end wall 26 and has a plurality of four end flaps 54, 55, 56, and 57 extending outwardly of score line 45 which are adapted to be suitably folded and fastened substantially coplanar to define the end wall 25.

The end flaps 50, 51, 52, and 53 are defined by parallel cutouts 60, 61, and 62 extending outwardly of score line 44 with cutout 60 being provided between end flaps 50 and 51, cutout 61 being provided between end flaps 51 and 52, and cutout 62 being provided between end flaps 52 and 53. Similarly the end flaps 54, 55, 56, and 57 are defined by parallel cutouts extending outwardly of score line 45 with cutout 63 being provided between end flaps 54 and 55, cutout 64 being provided between end flaps 55 and 56, and cutout 65 being provided between end flaps 56 and 57.

Figure 2:
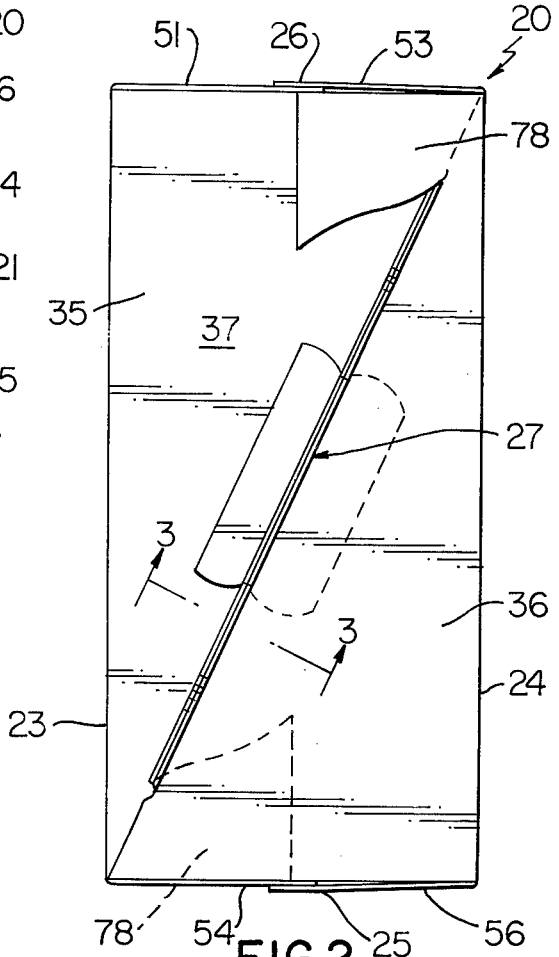
FIG. 2 is a top plan view of the carton of FIG. 1.
Figure 3:
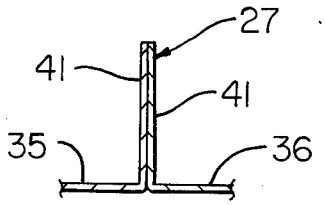
FIG. 3 is a fragmentary cross-sectional view taken essentially on the line 3—3 of FIG. 2.
Figure 7:
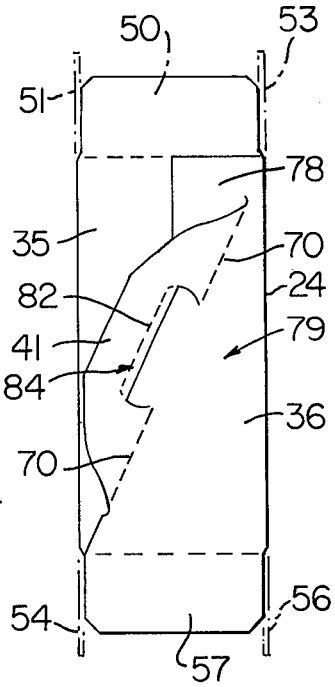
FIG. 7 is a view similar to FIG. 6 showing the other side of the carton disposed vertically with its extension flap extending horizontally and against the extension flap illustrated in FIG. 6 with its folded back handle portion and with the handle portions in alignment.
Figure 8:
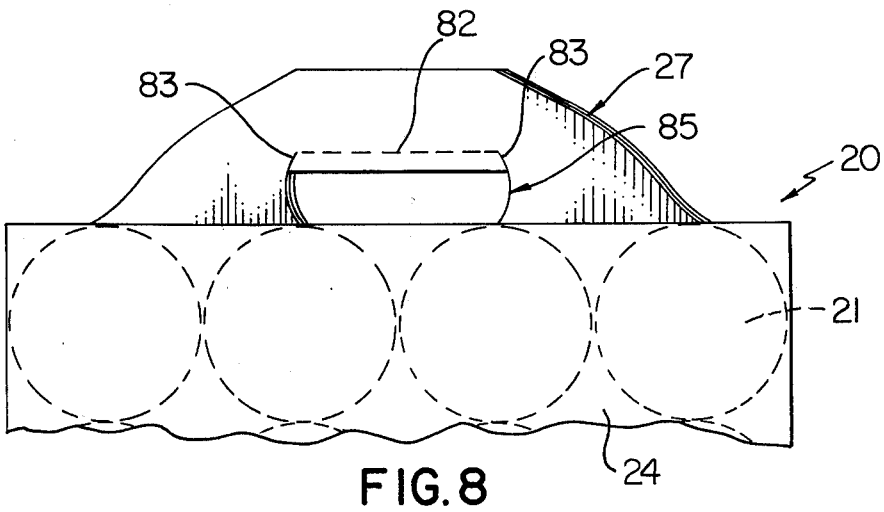
FIG. 8 is an enlarged view particularly illustrating the top portion of the carton of FIG. 1 with its handle disposed in its upstanding or vertical position.

As previously mentioned the cut and score means 40 in each of the extension flaps 35 and 36 defines an associated handle portion 41 with the handle portions 41 being disposed against each other as illustrated in FIGS. 1, 2, and 8 to define the handle 27 for the carton 20. The score means in each extension flap defining the handle portion will be readily apparent from FIGS. 4–7 and the score means in each extension flap 35 and 36 include a pair of spaced score lines each designated by the same reference numeral 70. The spaced score lines 70 are disposed in spaced end-to-end relation along a rectilinear path defined by a diagonal of the rectangular top wall 37 and in diagonally opposite corners of the top wall 37. The diagonally arranged or disposed score lines 70 in the opposite corners provide a comparatively rigid attachment for the handle portions 41 (and thus non-flexing load transfer to the side walls) with such rigid attachment assuring the handle 27 defined by the handle portions 41 has optimum strength due to minimum upward bowing of the top wall. The diagonally arranged score lines 70 of each extension flap 35 and 36 define an integral hinge of maximum length for the associated handle portion 41 which helps assure that the handle portion 41 and hence the handle 27, as defined by the fastened-together handle portions 41, has greater strength due to the mere fact that each of its component portions 41 has a substantial length of hinged attachment along a diagonal of the rectangular wall 37.

As best seen in FIGS. 1 and 4 of the drawings, each of the extension flaps 35 and 36 has a peripheral edge which is designated generally by the reference numeral 71 which defines the major portion of the peripheral edge of the associated handle portion 41. Each edge 71 has a central rectilinear portion 72 arranged in spaced relation from and parallel to the spaced score lines 70 defined in its associated flap either 35 or 36; and, the edge 71 includes a pair of inclined edge portions each designated by the same reference numeral 73 and each adjoining opposite ends of the central rectilinear portion 72. Each inclined edge portion 73 intersects a remote end of one of the pair of score lines 70 in the associated extension flap portion, either 35 or 36. The remote end of a score line 70 is defined as that end thereof more closely adjacent a corner of its associated extension flap and hence that end thereof more closely adjacent a corner of the top wall 37 in the assembled carton 20.

As previously mentioned, cut and score means 40 is provided in each of the extension flaps 35 and 36 and the cut means, in each flap 35 or 36, of such cut and score means comprises a roughly U-shaped cut which is designated generally by the reference numeral 74 with the cut being defined by an elongated rectilinear bight 75 adjoined at its opposite ends by a pair of arms 76 which in this example have an arcuate configuration. The bight 75 is spaced from and parallel to the central rectilinear portion 72 of the peripheral edge 71 and each of the arms 76 terminates at an inner end of an associated score line 70 with the inner end of the score line 70 being defined as that end more closely adjacent the central portion of its associated flap 35 or 36.

Figure 5:
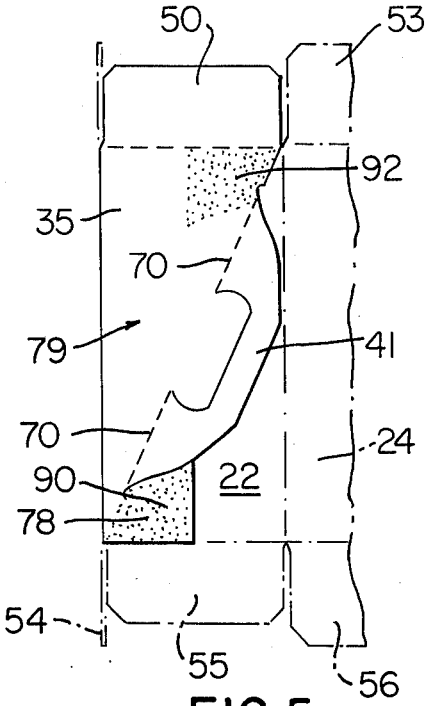
FIG. 5 is a view showing the blank of FIG. 4 with the central bottom wall defining portion arranged flatly on a horizontal surface and showing one side wall disposed vertically and an extension flap extending from such side wall disposed horizontally thereabove.
Figure 6:
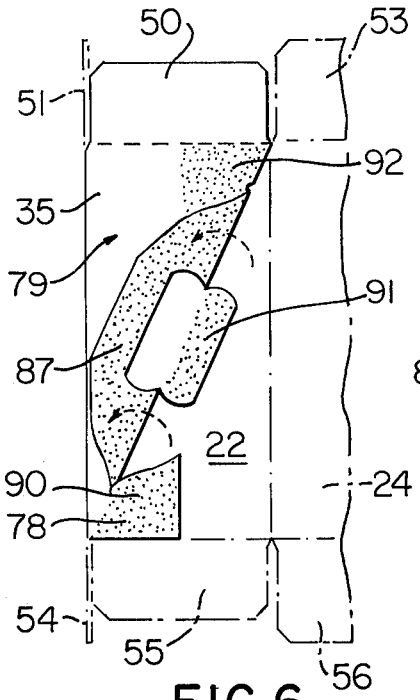
FIG. 6 is a view similar to FIG. 5 showing the handle portion in the extension flap folded back 180° flatly against the remainder of the extension flap and particularly showing adhesive means by dots on the flap.

As will be seen particularly from FIGS. 2 and 4 of the drawings, at least one of the inclined edge portions 73 of each handle portion 41 includes a non-rectilinear cut 77 into its associated extension flap either 35 or 36. The cut 77 in flap 35 defines a corner portion 78 in such flap which comprises the inside surface of the top wall 37 as shown in FIGS. 5–7. Similarly, the cut 77 in flap 36 defines a corner portion, also designated 78 which comprises the outside surface of the top wall 37.

Basically the top wall 37 is a single thickness top wall defined by what might be considered a pair of triangular portions 79 in the flaps 35 and 36. Each triangular portion 79 is disposed on one side of a diagonal in the top wall and most of handle portion 41 is arranged outwardly of the diagonal.

One of the extension flaps shown as the flap 36 in this example, has a hinge line 82 therein disposed between the rectilinear bight 75 of its U-shaped cut 74 and a central rectilinear outer edge 72 and a pair of slits each designated by the same reference numeral 83 each extending between associated ends of the hinge line 82 and the rectilinear bight 75 with the slits 83 and hinge line 82 defining a hinged tab which is designated generally by the reference numeral 84. The tab 84 is adapted to be folded about its hinge line and around an inner edge of the handle portion in the extension flap 35 with the tab providing a substantial surface enabling the carton 20 to be lifted. It will be appreciated that in ordinary useage, one technique for carrying such carton and its contents would be for a person to insert several fingers through an opening 85 of the handle 27 whereupon the hinged tab 84 would provide a substantial area preventing sharp edges of the material used to make the carton 20 from engaging and digging into such fingers.

The carton 20 has suitable adhesive means or adhesive shown in the form of dots 87 and such adhesive 87 is provided on the handle portions 41 to bond the handle portions together. In addition, it will be appreciated that suitable adhesive shown by dots at 90, 91, and 92 in each flap 35 and 36 is provided for bonding the flaps 35 and 36 to define the substantially single thickness top wall 37.

The carton 20 is preferably made from the blank 43 and such blank is folded essentially in the sequence illustrated in FIGS. 5, 6, and 7 of the drawings. Further, the flaps 54, 55, 56, and 57 defining end wall 25 are fastened together by suitable adhesive (not shown) while the flaps 50, 51, 52, and 53 are also suitably fastened together by adhesive (not shown).

As seen particularly in FIG. 1 of the drawings, the carton 20 has means designated generally by the reference numeral 95 defining a hinged door and a dispensing opening for the cans 21 within the carton 20; and, such means 95 comprises cut means 96 extending across the entire width of an end wall 25 and such cut means comprises a plurality of cuts which extend completely through the end wall material and are arranged in substantially end-to-end relation adjoined by comparatively short lengths of uncut or unsevered wall material. The means 95 includes the central part 44C of score line 44 which serves as a hinge and is arranged in spaced relation from the cut means 96 and the means 95 also includes cut means 97 in each of the side walls 23 and 24, defined similar to cut means 96. Each cut means 97 is arranged in an arcuate path and adjoining associated ends of the score line 44C and the cut means 96. Thus, upon severing along the cut means 96 and 97 a hinged dispensing door is defined having the score line 44C as its hinge.

The carton of this invention is particularly adapted to be used for containing cans of beverage and provides a high strength handle even when used with recycled paperboard or board of comparatively small thickness. For example, board stock having a thickness ranging between 22–26 points has been used to make such carton. In the art a point is defined as 0.001 inch.

Terms such as bottom wall, top wall, end wall, side wall, and the like, have been utilized in this disclosure and the appended claims merely to define the position of the walls of the carton of this invention as shown in the drawings; however, it is to be understood that the carton of this invention may be oriented in any desired manner.

While present embodiments of this invention, and methods of practicing the same, have been illustrated and described, it will be recognized that this invention may be otherwise variously embodied and practiced within the scope of the following claims.

What is claimed is:

1. A carton comprising, a bottom wall, a pair of side walls adjoining opposite side edges of said bottom wall with each of said side walls having an edge remote from said bottom wall, a pair of extension flaps each adjoining and extending from an associated remote edge, said extension flaps being fastened together to define a rectangular top wall for said carton, and cut and score means in each of said pair of extension flaps defining an associated handle portion with the handle portions from only said pair of extension flaps being disposed against each other to define a handle for said carton, said score means in each extension flap including a pair of spaced score lines disposed in spaced relation substantially along a diagonal in opposite corners of said rectangular top wall to thereby define an integral hinge for an associated handle portion, said diagonal score lines in said corners providing a comparatively rigid attachment for said handle portions with said rigid attachment assuring said handle has optimum strength due to less likelihood of upward bowing of said top wall.

2. A carton as set forth in claim 1 in which each of said extension flaps has a peripheral edge defining the major portion of the peripheral edge of an associated handle portion.

3. A carton as set forth in claim 2 in which said peripheral edge comprises a central rectilinear portion arranged in spaced relation from and parallel to said spaced score lines.

4. A carton as set forth in claim 1 in which said cut means in each extension flap comprises a roughly U-shaped cut, said cut being defined by an elongated rectilinear bight adjoined at opposite ends by a pair of arms, said bight being spaced from and parallel to said central rectilinear portion and each of said arms terminating at an inner end of an associated score line.

5. A carton as set forth in claim 4 in which said peripheral edge of each of said extension flaps includes a pair of inclined edge portions adjoining opposite ends of said central rectilinear portion with each inclined edge portion intersecting a remote end of one of said pair of score lines of an associated flap portion.

6. A carton as set forth in claim 5 in which a part of one of said inclined edge portions of each handle portion is defined by a cut into its associated extension flap.

7. A carton comprising, a bottom wall, a pair of side walls adjoining opposite side edges of said bottom wall with each of said side walls having an edge remote from said bottom wall, a pair of extension flaps adjoining and extending from an associated remote edge, said extension flaps being fastened together to define a rectangular top wall for said carton, and cut and score means in each of said extension flaps defining an associated handle portion with the handle portions being disposed against each other to define a handle for said carton, said score means in each extension flap including a pair of spaced score lines disposed in spaced relation substantially along a diagonal in opposite corners of said rectangular top wall to thereby define an integral hinge for an associated handle portion, said diagonal score lines in said corners providing a comparatively rigid attachment for said handle portions with said rigid attachment assuring said handle has optimum strength due to less likelihood of upward bowing of said top wall, said cut means in each extension flap comprising a roughly U-shaped cut, said cut being defined by an elongated rectilinear bight adjoined at opposite ends by a pair of arms, said bight being spaced from and parallel to said central rectilinear portion and each of said arms terminating at an inner end of an associated score line, one of said extension flaps having a hinge line therein disposed between the rectilinear bight of its U-shaped cut and its central rectilinear outer edge and a pair of slits each extending between associated ends of said hinge line and said rectilinear bight, said slits and hinge line defining a hinged tab in one of said handle portions, said tab being adapted to be folded about its hinge line and around an inner edge of the handle portion of the other of said extension flaps, said tab providing a substantial surface enabling said carton to be lifted free of sharp edges.

8. A carton as set forth in claim 7 and further comprising adhesive means bonding said handle portions together.

9. A carton as set forth in claim 7 and further comprising a pair of end walls each adjoining associated ends of said bottom wall, side walls, and top wall, said walls cooperating to define a carton having the general shape of a parallelepiped.

10. A carton as set forth in claim 9 in which each of said bottom and side walls has a pair of end flaps extending from opposite ends thereof and each of said extension flaps has an end flap extending from at least one end thereof with the end flaps at one end of said carton cooperating to define one of said pair of end walls and the end flaps at the other end of said carton cooperating to define the other of said pair of end walls.

11. A blank being suitably cut and scored to define a resulting carton upon assembly thereof, said blank comprising, a rectangular central portion adapted to define a bottom wall in said resulting carton, a pair of rectangular side portions adjoining said opposite side edges of said central portion and adapted to define a pair of side walls of said resulting carton, a pair of extension flaps each adjoining and extending from an associated remote edge, said extension flaps being adapted to be fastened together to define a rectangular top wall for said resulting carton, and cut and score means in each of said pair of extension flaps defining an associated handle portion with the handle portions from only said pair of extension flaps being disposed against each other in said resulting carton to define a handle therefor, said score means in each extension flap including a pair of spaced score lines disposed in spaced relation substantially along a diagonal in opposite corners of said rectangular top wall of said resulting carton to thereby define and integral hinge for an associated handle portion, said diagonal score lines in said corners providing a comparatively rigid attachment for said handle portions with said rigid attachment assuring said handle of said resulting carton has optimum strength due to less likelihood of upward bowing of said top wall of said resulting carton.

12. A blank as set forth in claim 11 in which each of said extension flaps has a peripheral edge defining the major portion of the peripheral edge of an associated handle portion.

13. A blank as set forth in claim 12 in which said peripheral edge comprises a central rectilinear portion arranged in spaced relation from and parallel to said spaced score lines.

14. A blank as set forth in claim 11 in which said cut means in each extension flap comprises a roughly U-shaped cut, said cut being defined by an elongated rectilinear bight adjoined at opposite ends by a pair of arms, said bight being spaced from a parallel to said central rectilinear poriton and each of said arms terminating at an inner end of an associated score line.

15. A blank as set forth in claim 14 in which said peripheral edge of each of said extension flaps includes a pair of inclined edge portions adjoining opposite ends of said central rectilinear portion with each inclined edge portion intersecting a remote end of one of said pair of score lines of an associated flap portion.

16. A blank as set forth in claim 15 in which a part of one of said inclined edge portions of each handle portion is defined by a cut into its associated extension flap.

17. A blank being suitably cut and scored to define a resulting carton upon assembly thereof, said blank comprising, a rectangular central portion adapted to define a bottom wall in said resulting carton, a pair of rectangular side portions adjoining said opposite side edges of said central portion and adapted to define a pair of side walls of said resulting carton, a pair of extension flaps each adjoining and extending from an associated remote edge, said extension flaps being adapted to be fastened together to define a rectangular top wall for said resulting carton, and cut and score means in each of said extension flaps defining an associated handle portion with the handle portions being disposed against each other in said resulting carton to define a handle therefor, said score means in each extension flap including a pair of spaced score lines disposed in spaced relation substantially along a diagonal in opposite corners of said rectangular top wall of said resulting carton to thereby define an integral hinge for an associated handle portion, said diagonal score lines in said corners providing a comparatively rigid attachment for said handle portions with said rigid attachment assuring said handle of said resulting carton has optimum strength due to less likelihood of upward bowing of said top wall of said resulting carton, said cut means in each extension flap comprising a roughly U-shaped cut, said cut being defined by an elongated rectilinear bight adjoined at opposite ends by a pair of arms, said bight being spaced from a parallel to said central rectilinear portion and each of said arms terminating at an inner end of an associated score line, one of said extension flaps having a hinge line therein disposed between the rectilinear bight of its U-shaped cut and its central rectilinear outer edge and a pair of slits each extending between associated ends of said hinge line and said rectilinear bight, said slits and hinge line defining a hinged tab in one of said handle portions, said tab being adapted to be folded about its hinge line and around an inner edge of the handle portion of the other of said extension flaps, said tab providing a substantial surface enabling said resulting carton to be lifted free of sharp edges.

18. A blank as set forth in claim 17 and further comprising adhesive means on said handle portions adapted to fasten said handle portions together.

19. A blank as set forth in claim 17 in which each of said rectangular central portions and said rectangular side portions has a pair of end flaps extending from opposite ends thereof and each of said extension flaps has an end flap extending from at least one end thereof, with the end flaps at one end of said blank cooperating to define one of a pair of end walls in said resulting carton and the end flaps at the other end of said blank cooperating to define the other of said pair of end walls in said resulting carton.

20. A blank as set forth in claim 19 in which each of said end flaps in substantially rectangular and has a score line defining the base thereof.

* * * * *